US007237489B2

(12) United States Patent
Naderhoff et al.

(10) Patent No.: US 7,237,489 B2
(45) Date of Patent: Jul. 3, 2007

(54) PROJECTILE HEAD FOR A TRAINING CARTRIDGE

(75) Inventors: Uwe Naderhoff, Hermannsburg (DE); Jürgen Kolodzev, Fassberg (DE); Martin Berg, Celle (DE)

(73) Assignee: Rheinmetall Waffe Munition GmbH, Aschau am Inn (DE)

( * ) Notice: Subject to any disclaimer, the term of this patent is extended or adjusted under 35 U.S.C. 154(b) by 144 days.

(21) Appl. No.: 10/919,478

(22) Filed: Aug. 17, 2004

(65) Prior Publication Data

US 2005/0183614 A1 Aug. 25, 2005

(30) Foreign Application Priority Data

Aug. 20, 2003 (DE) ..... 103 38 185

(51) Int. Cl.
*F42B 8/12* (2006.01)

(52) U.S. Cl. ..... 102/498; 102/444; 102/502; 102/529

(58) Field of Classification Search ..... 102/498, 102/529, 444, 447, 502, 439, 445, 446
See application file for complete search history.

(56) References Cited

U.S. PATENT DOCUMENTS 4,211,168 A 7/1980 Häep
4,446,794 A * 5/1984 Simmons ..... 102/513
4,498,396 A 2/1985 Bérubé
5,001,986 A * 3/1991 Meister ..... 102/529
5,027,710 A * 7/1991 Wittmann et al. ..... 102/513
5,257,936 A * 11/1993 Ambrosi et al. ..... 434/11
5,333,551 A * 8/1994 Heitmann et al. ..... 102/439

FOREIGN PATENT DOCUMENTS

DE 42 02 780 A1 8/1993
DE 198 06 958 A1 9/1999
EP 1508767 A1 * 2/2005

* cited by examiner

*Primary Examiner*—James S. Bergin
(74) *Attorney, Agent, or Firm*—Venable LLP

(57) ABSTRACT

A projectile head is provided for a training cartridge having a propulsion unit, with an integrated projectile tail section, which can be used equally for training cartridges as well as combat cartridges of the same caliber size, wherein the projectile tail section is connectable to the projectile head with the aid of an extension on the projectile tail section, the extension is insertable into a receptacle in the projectile head, and the extension contains a recessed area, open on the front, for receiving a warhead detonator. The projectile head has a receptacle in the projectile head for receiving the extension of the projectile tail section, and an end stop which extends into the receptacle. The end stop is for contacting a warhead detonator present on the projectile tail section during assembly of the propulsion unit and the projectile head to prevent the extension from reaching a fully assembled position in the receptacle.

7 Claims, 2 Drawing Sheets

1
3
4
5
6
7
7
8
9
10
11
12
13
14
15
16
17
18
19
20
21

PROJECTILE HEAD FOR A TRAINING CARTRIDGE

CROSS REFERENCE TO RELATED APPLICATION

This application claims the priority of German Patent Application, DE 103 38 185.6 filed Aug. 20, 2003, which is incorporated herein by reference.

BACKGROUND OF THE INVENTION

The invention relates to a projectile head for a training cartridge.

German reference DE 42 02 780 A1 already discloses a modular design for large-caliber multi-purpose cartridges (MZ cartridge), for example cartridges fired from 120 mm tank cannons. Among other things, a modular design of this type has the advantage of making it possible to decide, even on location (meaning immediately prior to firing the cartridge), whether a training projectile or a combat projectile with identical caliber is to be fired.

The same propulsion unit is therefore used for the practice cartridge and the combat cartridge which additionally comprises a projectile tail section that can be connected to either of the two projectile types. To connect the propulsion unit to the respective projectile head, the projectile tail section is provided with a conical extension that projects from the propulsion unit, on the side facing the projectile head. This extension is screwed into a corresponding opening in the projectile head. Before screwing together the propulsion unit and the projectile head, however, a warhead detonator generally must also be inserted into a recessed area in the conical extension of the projectile tail section, which recessed area is open on the side facing the projectile head.

It has turned out that the removal of the warhead detonator is easily forgotten during the conversion on location from a combat cartridge to a training cartridge. That is to say, the cartridge still contains the warhead detonator during the subsequent firing, thus resulting in undesirable danger to individuals using the training projectile, as well as to the surrounding area.

SUMMARY OF THE INVENTION

It is an object of the present invention to specify a projectile head for a training cartridge as defined above, which can be connected to a propulsion unit to form the training cartridge, but only if it is ensured that no warhead detonator is located inside the propulsion unit.

The invention is essentially based on the idea of providing the projectile head for the training cartridge on the side facing the propulsion unit with an end stop projecting into the recessed area. Thus, if a warhead detonator exists, this detonator hits the end stop during the operation of connecting the propulsion unit and the projectile head and prevents the extension on the projectile tail section from reaching its final position in the receptacle in the projectile head.

Particularly easy to install is an end stop in the form of a pin, which extends perpendicular to the longitudinal axis of the projectile head through the recessed area.

If a screw connection is provided between the projectile head and the propulsion unit, it has proven particularly advantageous if a warhead detonator that may be present hits the end stop early enough, so that the threads of the components cannot come in contact and the propulsion unit and the projectile head cannot be screwed together.

Insofar as the projectile head is provided with a driving band on the tail end, it has proven advantageous if the pin-shaped end stop extends below the driving band into or through the recessed area and is guided on the side by at least one bore in the projectile head wall that extends up to the driving band. An arrangement of this type has the advantage of making sure that an end stop actually exists even during the assembly of the training projectile. Otherwise, plastic material would flow during the injection molding of the driving band through the bore in the projectile head and into the recessed area and a driving band would not form. The driving band is furthermore fixed in place by this end stop.

To ensure a quick installation of the pin-shaped extension on the projectile head, it has furthermore proven advantageous to provide the pin with a pin head, arranged inside an expanded bore which directly follows the driving band, wherein the pin length is selected such that it engages with the end opposite the head in a blind bore in the projectile head wall.

Particular embodiments of the invention provide a projectile head for a training cartridge having a propulsion unit, with an integrated projectile tail section, which can be used equally for training cartridges as well as combat cartridges of the same caliber size, wherein the projectile tail section is connectable to the projectile head with the aid of an extension on the projectile tail section, the extension is insertable into a receptacle in the projectile head, and the extension contains a recessed area, open on the front, for receiving a warhead detonator. The projectile head has a receptacle in the projectile head for receiving the extension of the projectile tail section, and an end stop which extends into the receptacle. The end stop is for contacting a warhead detonator present on the projectile tail section during assembly of the propulsion unit and the projectile head to prevent the extension from reaching a fully assembled position in the receptacle.

Compared to known, comparable training cartridges, the invention considerably increases the operational safety of the training cartridge by preventing incorrect handling while simultaneously ensuring the later operational safety ahead of time during the assembly.

BRIEF DESCRIPTION OF THE DRAWINGS

Further advantages and details of the invention follow from the exemplary embodiments and are explained in the following with the aid of the Figures, in which.

DETAILED DESCRIPTION OF THE INVENTION

Figure 1:
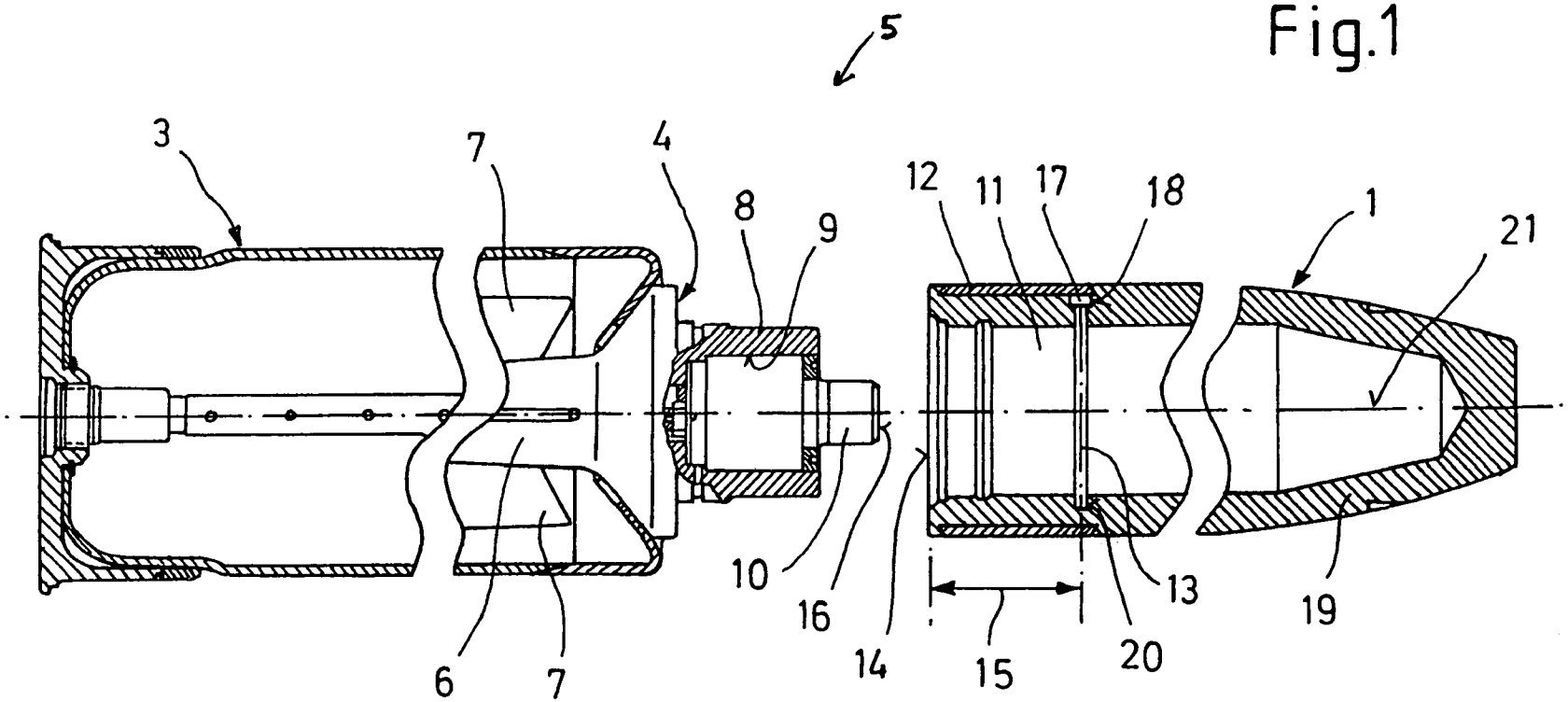
FIG. 1 is a longitudinal section through an example of a projectile head according to the invention and a propulsion unit with a warhead detonator arranged on the projectile head side.

FIG. 1 shows the respective training projectile 5, comprising a projectile head 1 for a training cartridge 2 (FIG. 3) and a propulsion unit 3 with integrated projectile tail section 4, which is known per se. The tail section 4 of the training projectile 5, comprising a shaft section 6 with folding fins 7 arranged thereon, is provided on the projectile head side with a conical extension 8 with an external thread. The conical extension 8 contains a recessed area 9, open toward the front, with therein disposed a warhead detonator 10.

The hollow-shaped projectile head 1 is provided on the tail side with a receptacle 11, having a thread for accommodating the conical extension 8 on the propulsion unit 3, and on the outside with a driving band 12.

According to the invention, the projectile head 1 comprises a pin-shaped end stop 13 on the side facing the propulsion unit 3, which extends perpendicular to the longitudinal axis 21 of the projectile head 1. The end stop 13, in this example, extends completely through the receptacle 11. This end stop 13 is positioned at a distance 15 from the rear end face 14 of the projectile head 1. Distance 15 is selected such that during the connecting of the propulsion unit 3 and the projectile head 1 (FIG. 2), the end stop 13 hits the front end face 16 of the warhead detonator 10 before the threads of these components can come in contact, thus preventing a screwing together of propulsion unit 3 and projectile head 1.

Figure 2:
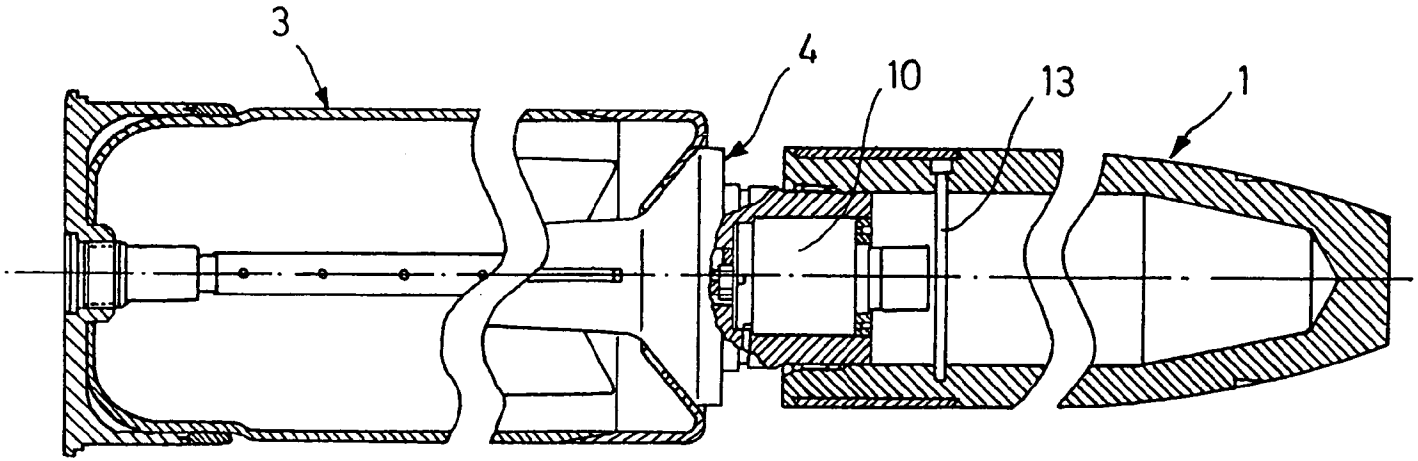
FIG. 2 is a view corresponding to FIG. 1, showing the attempt to connect the projectile head and the propulsion unit
Figure 3:
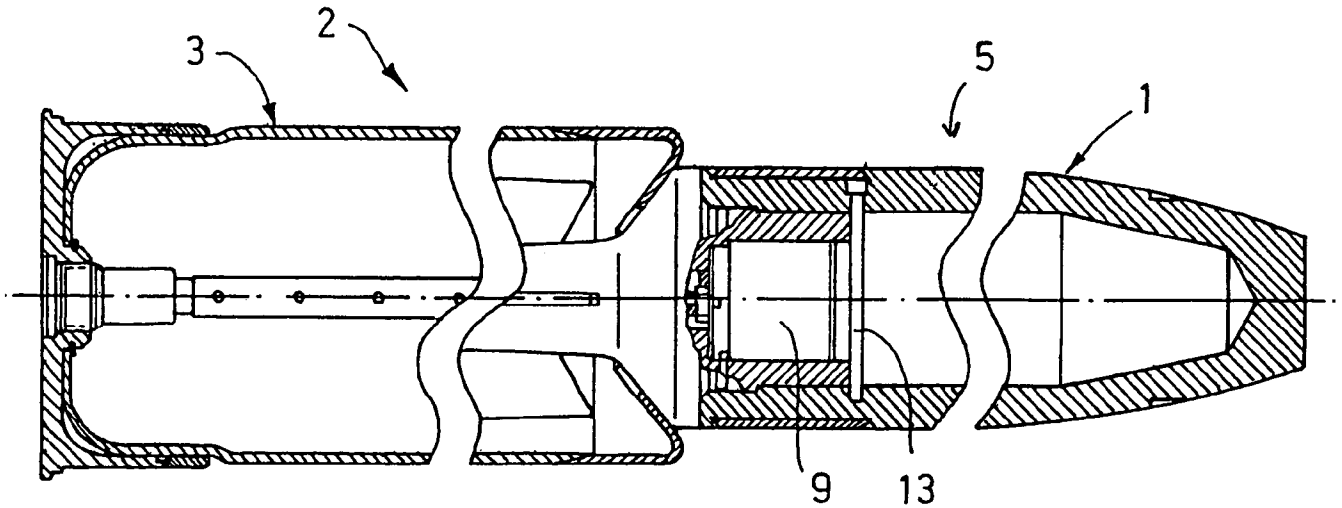
FIG. 3 is a training cartridge comprising a propulsion unit and a projectile head according to the invention.

FIGS. 1–3 show that the pin-shaped end stop 13 is located in the region below the driving band 12 of the projectile head 1. On one side, this end stop supports itself with a head section 17 in an expanded bore 18 of the projectile head wall 19, which is located directly below the driving band 12. On the opposite side of head section 17, the end stop 13 extends into a blind bore 20 in the projectile head wall 19.

Of course, the invention is not limited to the above-described exemplary embodiment and does not necessarily have to be in the shape of a pin. For example, it can also have a bracket-type design.

It will be apparent, based on this disclosure, to one of ordinary skill in the art that many changes and modifications can be made to the invention without departing from the spirit and scope thereof.

What is claimed is:

1. A projectile head for a training cartridge having a propulsion unit, with an integrated projectile tail section, which can be used equally for training cartridges as well as combat cartridges of the same caliber size, wherein the projectile tail section is connectable to the projectile head with the aid of an extension on the projectile tail section, the extension is insertable into a receptacle in the projectile head, and the extension contains a recessed area, open on the front, for receiving a warhead detonator, the projectile head comprising:

a receptacle in the projectile head for receiving the extension of the projectile tail section; and an end stop which extends into the receptacle, wherein the end stop is for contacting a warhead detonator present on the projectile tail section during assembly of the propulsion unit and the projectile head to prevent the extension from reaching a fully assembled position in the receptacle, the projectile head is attachable by a threaded connection to the propulsion unit, and the end stop is arranged in the projectile head such that, if the warhead detonator is present, the end stop is for contacting the warhead detonator before threads on the propulsion unit come in contact with threads on the projectile head, therefore preventing the projectile head from being connected to the propulsion unit.

2. The projectile head according to claim 1, wherein the end stop has a pin- shaped design and extends through the receptacle, perpendicular to a longitudinal axis of the projectile head.

3. The projectile head according to claim 1 wherein the receptacle is for receiving a conical extension of the projectile tail section.

4. A projectile head for a training cartridge having a propulsion unit, with an integrated projectile tail section, which can be used equally for training cartridges as well as combat cartridges of the same caliber size, wherein the projectile tail section is connectable to the projectile head with the aid of an extension on the projectile tail section, the extension is insertable into a receptacle in the projectile head, and the extension contains a recessed area, open on the front, for receiving a warhead detonator, the projectile head comprising:

a receptacle in the projectile head for receiving the extension of the projectile tail section; and an end stop which extends into the receptacle, wherein the end stop is for contacting a warhead detonator present on the projectile tail section during assembly of the propulsion unit and the projectile head to prevent the extension from reaching a fully assembled position in the receptacle, and the end stop has a pin-shaped design and extends through the receptacle, perpendicular to a longitudinal axis of the projectile head.

5. The projectile head according to claim 4, further comprising a driving band, wherein the pin-shaped end stop extends below the driving band into the receptacle and is guided by at least one bore in the projectile head that extends up to the driving band.

6. The projectile head according to claim 5, wherein the bore is expanded at the driving band and the pin-shaped end stop is provided with a head section, arranged within the expanded bore.

7. The projectile head according to claim 6, wherein an end of the pin-shaped end stop opposite its head section engages in a blind bore of the projectile head.

* * * * *